US008967899B1

(12) United States Patent
Chu et al.

(10) Patent No.: US 8,967,899 B1
(45) Date of Patent: Mar. 3, 2015

(54) INK PEN WITH FIRE STARTER AND WHISTLE

(71) Applicant: Taylor Brands, LLC, Kingsport, TN (US)

(72) Inventors: Jiun-Yu Chu, Taipei Hsien (TW); Morgan Taylor, Kingsport, TN (US)

(73) Assignee: Taylor Brands, LLC, Kingsport, TN (US)

( * ) Notice: Subject to any disclaimer, the term of this patent is extended or adjusted under 35 U.S.C. 154(b) by 288 days.

(21) Appl. No.: 13/650,911

(22) Filed: Oct. 12, 2012

Related U.S. Application Data

(63) Continuation-in-part of application No. 12/833,376, filed on Jul. 9, 2010, now Pat. No. 8,348,539.

(51) Int. Cl.
*B43K 29/00* (2006.01)
*B43K 29/16* (2006.01)
*B43K 29/20* (2006.01)

(52) U.S. Cl.
CPC ..... *B43K 29/16* (2013.01); *B43K 29/005* (2013.01); *B43K 29/20* (2013.01)
USPC ..... 401/195; 431/273; 44/507

(58) Field of Classification Search
CPC ..... B43K 29/16; B43K 29/20; B43K 29/005
USPC ..... 401/195; 44/506–510; 431/273
See application file for complete search history.

(56) References Cited

U.S. PATENT DOCUMENTS

| | | | | |
|---|---|---|---|---|
| 3,448,541 | A * | 6/1969 | Barlow | 446/81 |
| 4,698,068 | A | 10/1987 | Jensen | |
| 4,770,669 | A | 9/1988 | Allen et al. | |
| 5,214,853 | A | 6/1993 | Bray et al. | |
| 5,279,628 | A | 1/1994 | Hutchens et al. | |
| 5,454,657 | A | 10/1995 | Kim | |
| 5,580,239 | A | 12/1996 | Jang | |
| 5,645,415 | A | 7/1997 | Hamel | |
| 5,919,037 | A | 7/1999 | Brillhart, III et al. | |
| 6,782,576 | B1 | 8/2004 | Valencic et al. | |
| 7,176,367 | B2 * | 2/2007 | Yeh | 84/380 R |
| 7,866,840 | B2 | 1/2011 | Padden | |
| 8,186,995 | B2 | 5/2012 | Putrello, Jr. | |
| 8,348,539 | B2 | 1/2013 | Chu et al. | |
| 2010/0136495 | A1 | 6/2010 | Weston et al. | |

* cited by examiner

*Primary Examiner* — David Walczak
*Assistant Examiner* — Jennifer C Chiang
(74) *Attorney, Agent, or Firm* — Luedeka Neely Group, PC

(57) ABSTRACT

A writing pen, including a first pen portion containing an ink cartridge, a ferro rod extending from the first pen portion, and a removable second pen portion removably positionable over the first pen portion. The second pen portion includes a whistle integrally formed therewith. A third pen portion is removably positionable over the first pen portion and overlys the ferro rod to substantially conceal the ferro rod. A removable striker having a first end configured for contacting the ferro rod is installable onto the third pen portion so that either the first end of the striker or the second end of the striker extends outwardly from the third pen portion.

3 Claims, 5 Drawing Sheets

INK PEN WITH FIRE STARTER AND WHISTLE

CROSS-REFERENCE TO RELATED APPLICATION

This application is a continuation-in-part of co-pending U.S. application Ser. No. 12/833,376, filed Jul. 9, 2010, and entitled INK PEN WITH FIRESTARTER, incorporated by reference herein in its entirety.

FIELD

This disclosure relates to the field of survival tools. More particularly, this disclosure relates to a survival pen configured to enable the generation of sparks for the starting a fire and having a built in whistle.

BACKGROUND

Many people frequently enjoy participation in outdoor activities such as hiking, backpacking, hunting, and fishing. With an increasing number of people participating in outdoor activities, these people occasionally find themselves stranded or lost in the wilderness. In addition to those seeking outdoor activities, some people find themselves stranded in the wilderness unintentionally, such as those that get lost while driving or in other transportation accidents. When lost in the wilderness, people often find themselves lacking the necessities for survival. One of these necessities is fire. Starting a fire provides a person lost in the wilderness with a source of heat, a method of signaling for help, and a method for preparing food or boiling water.

A whistle is also desired when one is in the wilderness. Whistles are useful for signaling for help and can help locate a person who might not be visible due to overgrowth, terrain, and the like.

Various devices have been constructed to provide a source of fire in emergencies. These devices are typically standalone fire starters that a person must remember to carry with them in order for the device to be useful in the event a source of fire is needed. These previous devices also typically have only been useful for starting a fire and have not been combined with any other useful tool. Combining the fire starter with an additional useful tool increases the likelihood that a person will be carrying the device when an emergency situation arises. Accordingly, there is a need for a survival device that functions as a fire starter, a whistle, and a useful tool that a user is likely to be carrying on themselves in case of an emergency.

The present disclosure provides an ink pen with fire starter for functioning as a writing instrument and both a whistle and a survival fire starting device.

SUMMARY

The above and other needs are met by a wring pen according to the disclosure which has both a whistle and the ability to be used to start a fire.

In one aspect, the pen includes a first pen portion containing an ink cartridge; a ferro rod extending from the first pen portion. A removable second pen portion is removably positionable over the first pen portion.

The second pen portion includes a whistle integrally formed therewith and having a windway to enable air to flow from a mouthpiece defined on the second pen portion, the whistle being operable when the second pen portion is positioned over the first pen portion and also when the second pen portion is removed from the first pen portion;

A removable third pen portion is removably positionable over the first pen portion and overlying the ferro rod to substantially conceal the ferro rod. The pen also includes a removable striker having a first end configured for contacting the ferro rod to produce a spark and a second opposite end. The striker is reversibly installable onto the second portion so that either the first end of the striker or the second end of the striker extends outwardly from the third pen portion;

The striker may be installed onto the third pen portion and the third pen portion removed from the first pen portion to expose the ferro rod, and the user may install the striker on the third pen portion to position the first end of the striker to extend outwardly from the third pen portion and manipulate the striker to strike against the ferro rod to generate sparks for making a fire.

Pens according to the disclosure are well-suited for carrying as a survival tool on camping trips and other situations where it may become necessary to start a fire, or use a whistle to signal for help. However, the pens have substantially normal pen dimensions and function as a writing pen.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
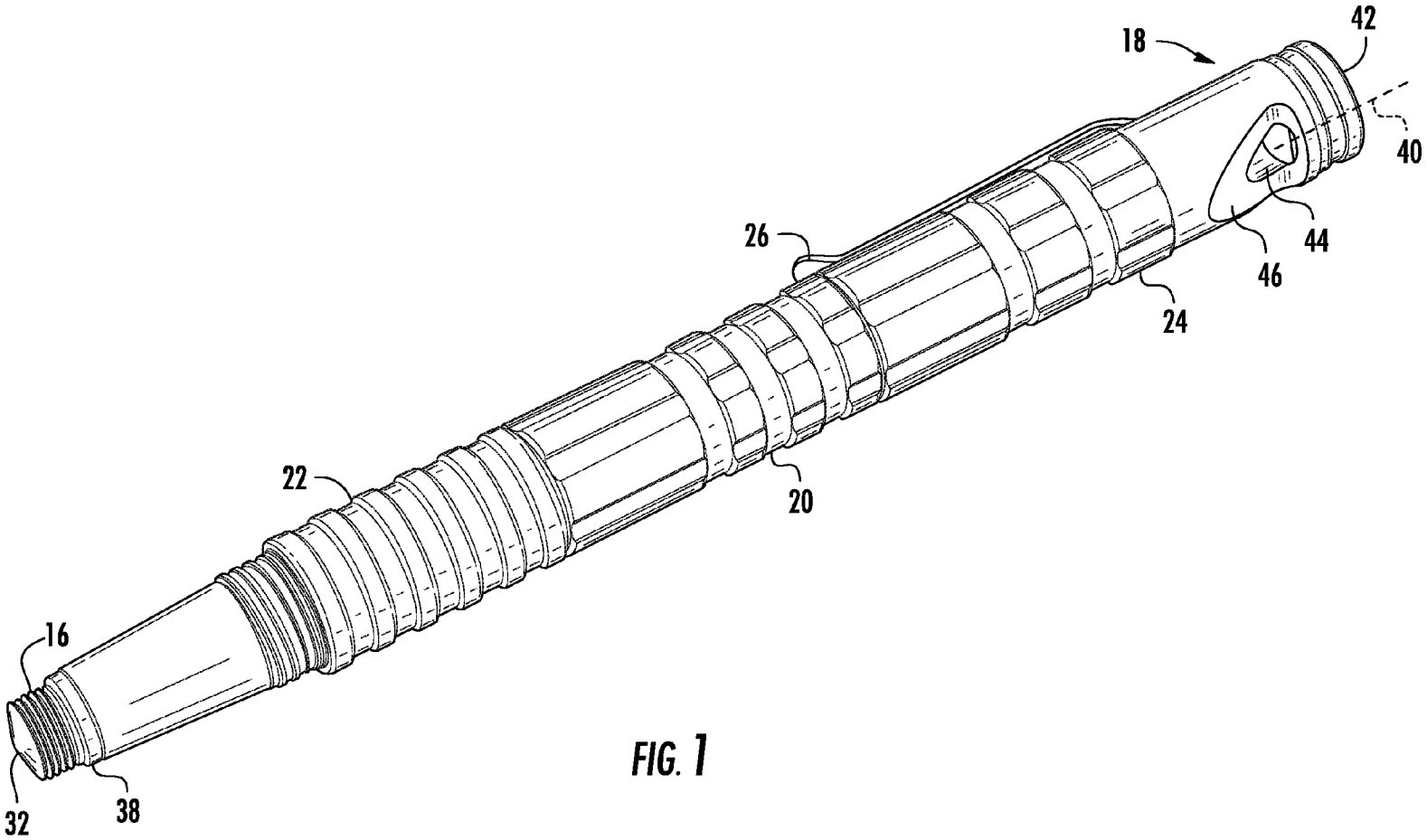
FIG. 1 is a perspective view of a pen according to the disclosure.
Figure 2:
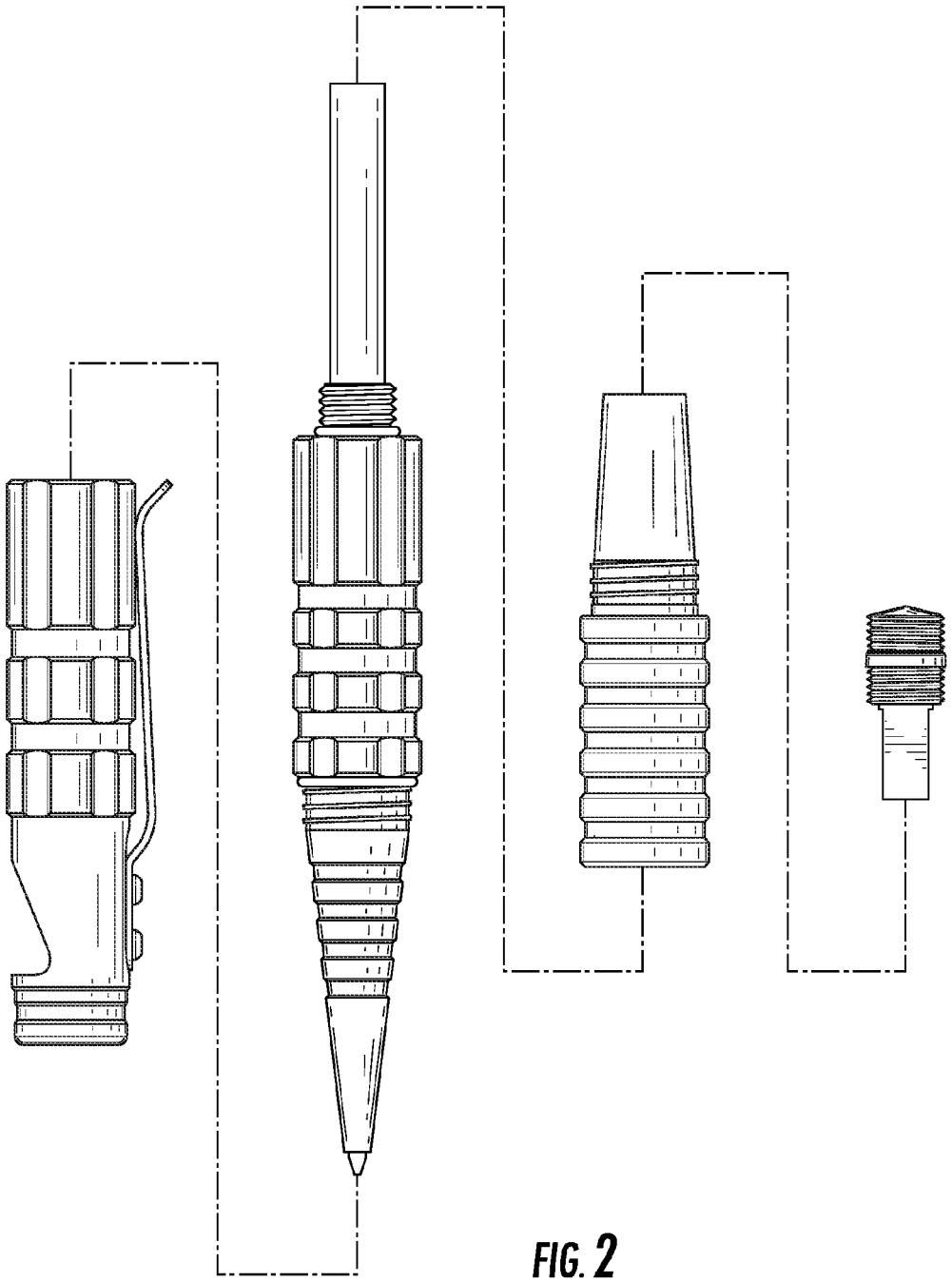
FIG. 2 is an exploded view of the pen of FIG. 1.

With reference to the drawings, the disclosure relates to an ink pen 10 including an ink pen cartridge 12, a ferro rod 14, a striker 16, and a whistle 18. The pen 10 is well-suited for carrying as a survival tool on camping trips and other situations where it may become necessary to start a fire. The pen 10 is also devoid of any combustibles so as to not be subject to travel restrictions.

The pen 10 further includes a main writing pen body portion 20, a removable pen body portion 22, and a removable pen cap 24. The body portion 20, body portion 22, and cap 24 are threadably joinable. The joinder of these components may be fluidly sealed if desired, as by incorporation of an o-ring at the threaded connections thereof. A clip 26 may be provided, such as on the cap 24, to allow the pen 10 to be attached to a shirt pocket. The body portions 20 and 22 and the cap 24 are preferably of a hard material such as steel, titanium, or a hardened plastic, and include aesthetically pleasing exterior design features as shown.

The structure of the pen 10 enables a person to carry a writing utensil that may serve as a fire starter by striking structure associated with the striker portion 16 against the ferro rod 14 to create a spark. The pen 10 is also advantageously configured to have an aesthetically pleasing configuration which is suitable for everyday carry when the need for the fire starting function is not anticipated.

The ink pen cartridge 12 may preferably be a conventional ball point pen cartridge. The ferro rod 14 is preferably constructed from ferrocerium or other flint-like metallic materials used for creating a spark. The ferro rod 14 is also preferably configured in a cylindrical shape, however, it is also understood that the ferro rod 14 may be in a rectangular or other configuration compatible with the structure of the pen 10. Threads are located on one end of the ferro rod 14 to permit the ferro rod 14 to be removably mounted on the main writing pen body portion 20.

The striker 16 includes a flat and relatively thin elongate plate 30 made of a metal or other material such as tungsten carbide and suitable for contacting the ferro rod 14 to produce a spark. The end of the striker 16 opposite the flat elongate portion 16*a* is configured to include a pointed head 32 suitable for use in striking glass for breaking the glass. For example, in the event the user is trapped in a car or the like, the user may grasp the pen 10 and strike the pointed head 32 against the glass to break the glass. The striker 16 includes a thread set 34 adjacent the flat elongate plate 30 and a thread set 36 adjacent the pointed head 32. A band 38 may be provided to separate the thread sets 34 and 36 and provide a stop.

The whistle 18 is preferably integrally formed with the cap 24 so as to not require a cap structure that is larger than a typical pen cap to aid in maintaining exterior dimensions substantially corresponding to those of an ordinary writing pen. The whistle 18 includes basic whistle structures including a windway represented by arrow 40 to enable air to flow from a mouthpiece 42 to a window 44 formed on a lip 46. The whistle 18 may be used with the cap 24 assembled onto the remainder of the pen 10, or removed from the pen 10.

The main writing pen body portion 20 is configured as a cylinder having an interior bore for receiving the ink pen cartridge 12, with a lowermost opening 50 that is sufficiently small to prevent a shoulder or other abutting structure of the cartridge 12 from passing therethrough but sufficiently large to permit a writing point of the ink cartridge 12 to extend therepast as shown. The opposite end of the main body portion 20 has an opening 52 large enough to permit installation of the ink cartridge 12. The interior of the opening 32 is threaded to threadably receive a correspondingly threaded end of the ferro rod 14 so that the ferro road 14 may be installed to block and extend from the opening 32 in a direction generally aligned with the length axis of the body portion 20 and away from the opening 32. Threads 54 are located on the exterior of the body portion 20 adjacent the opening 32 for threadably receiving corresponding interior threads of the removable pen body portion 22 so that the body portions 20 and 22 may be threadably joined. The exterior of the main body portion 20 below the opening 52 is configured for grasping by the user for writing and is tapered toward the lowermost opening 50. Threads 56 are located on the exterior of the body portion 20 above the opening 52 for threadably receiving corresponding interior threads of the cap 24 so that the body portion 20 and the cap 24 may be threadably joined.

Figure 3:
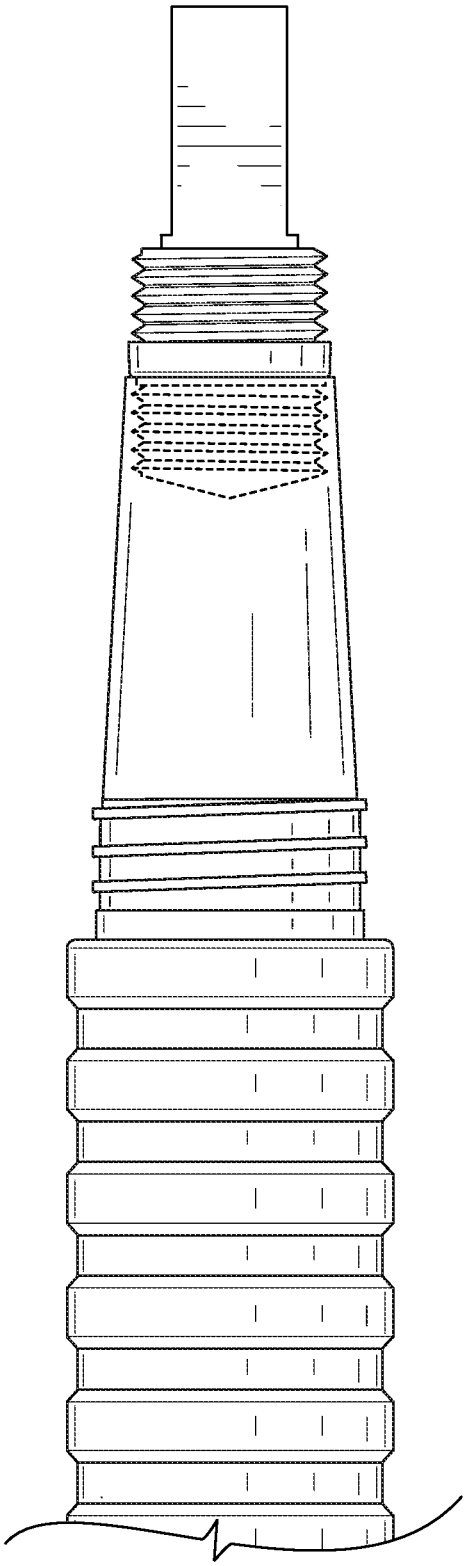
FIG. 3 shows installation of a striker component onto the cap for positioning the striker component for striking a ferro rod component.
Figure 4:
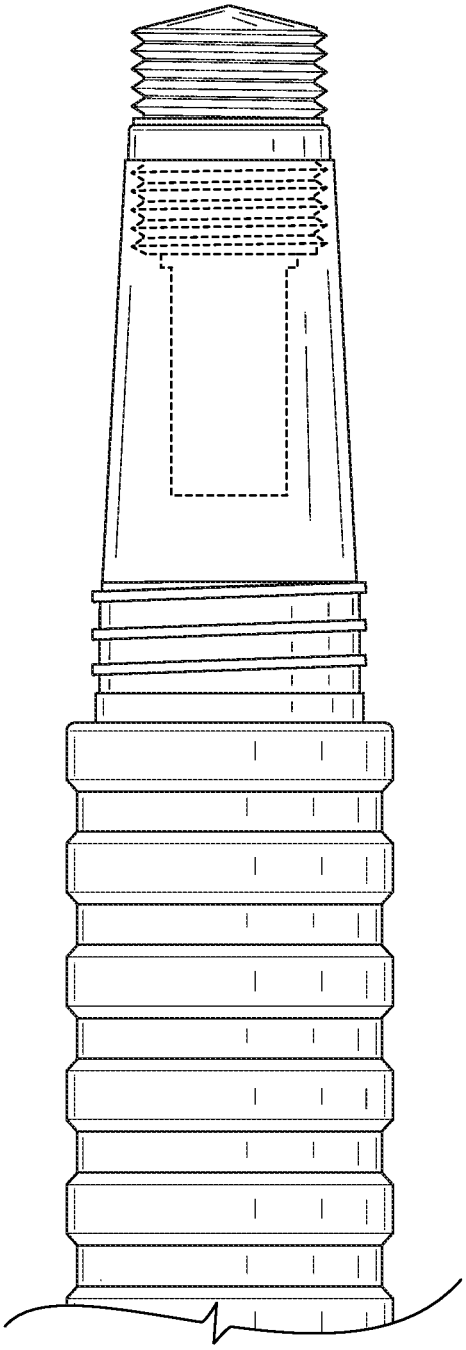
FIG. 4 shows installation of the striker component onto the cap for positioning the striker component to be hidden.

The removable pen body portion 22 is configured as a cylinder having opposite open ends 60 and 62 having threads interiorly thereof. The threads of the end 60 are configured for threadably engaging the threads 54 adjacent the opening 52 of the main writing pen body portion 20. The interior threads of the opposite end 62 of the removable pen body portion 22 are configured for selectively threadably receiving the thread sets 34 and 36 of the striker 16. For example, as shown in FIGS. 3 and 4, the striker 16 may be threadably installed on the body portion 22 to selectively expose the elongate plate 30 or the pointed head 32. When the cap 24 is removed to use the pen 10 as a writing pen, it is desirable to install the cap 24 on the body portion 22. Threads 64 are located on the exterior of the body portion 20 adjacent the end 62 for threadably receiving corresponding interior threads of the cap 24 so that the cap 24 may be threadably positioned on the body portion 22 so that the cap 24 is not lost when the cap 24 is removed to expose the pen cartridge 12.

The cap 24 is configured to have the whistle 18 at one end and an opposite open end 70 having threads interiorly thereof. The threads of the end 70 are configured for threadably engaging the threads 56 of the main writing pen body portion 20 and the threads 64 of the body portion 22. As explained above, the cap 24 may be installed onto the body portion 20 to cover the ink cartridge 12, or onto the body portion 22 such as when the cap 24 is removed to expose the ink cartridge 12.

Figure 5:
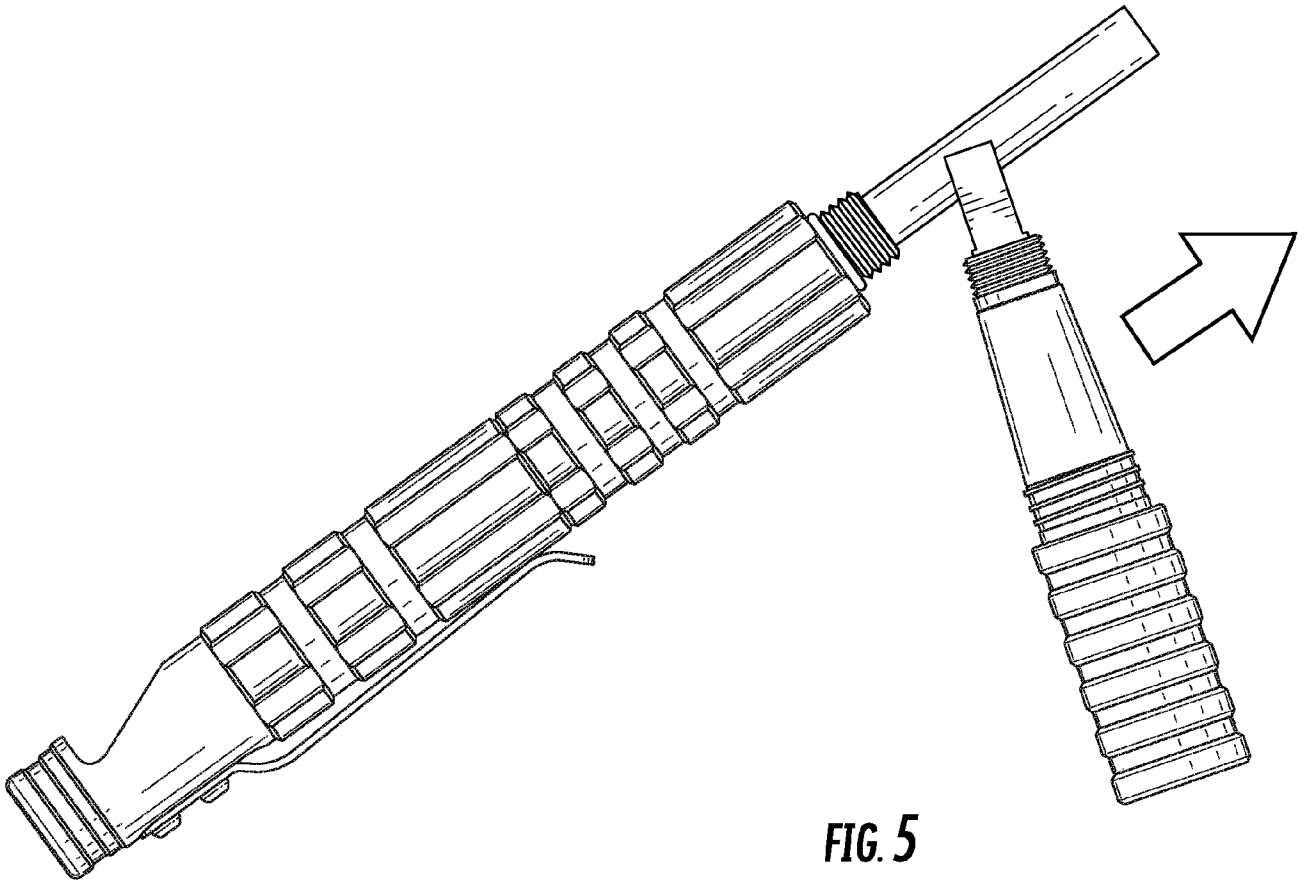
FIG. 5 is a perspective view of the pen of FIG. 1 having the ferro rod component exposed and the striker component shown engaging the ferro rod for use in starting a fire.
Figure 1:
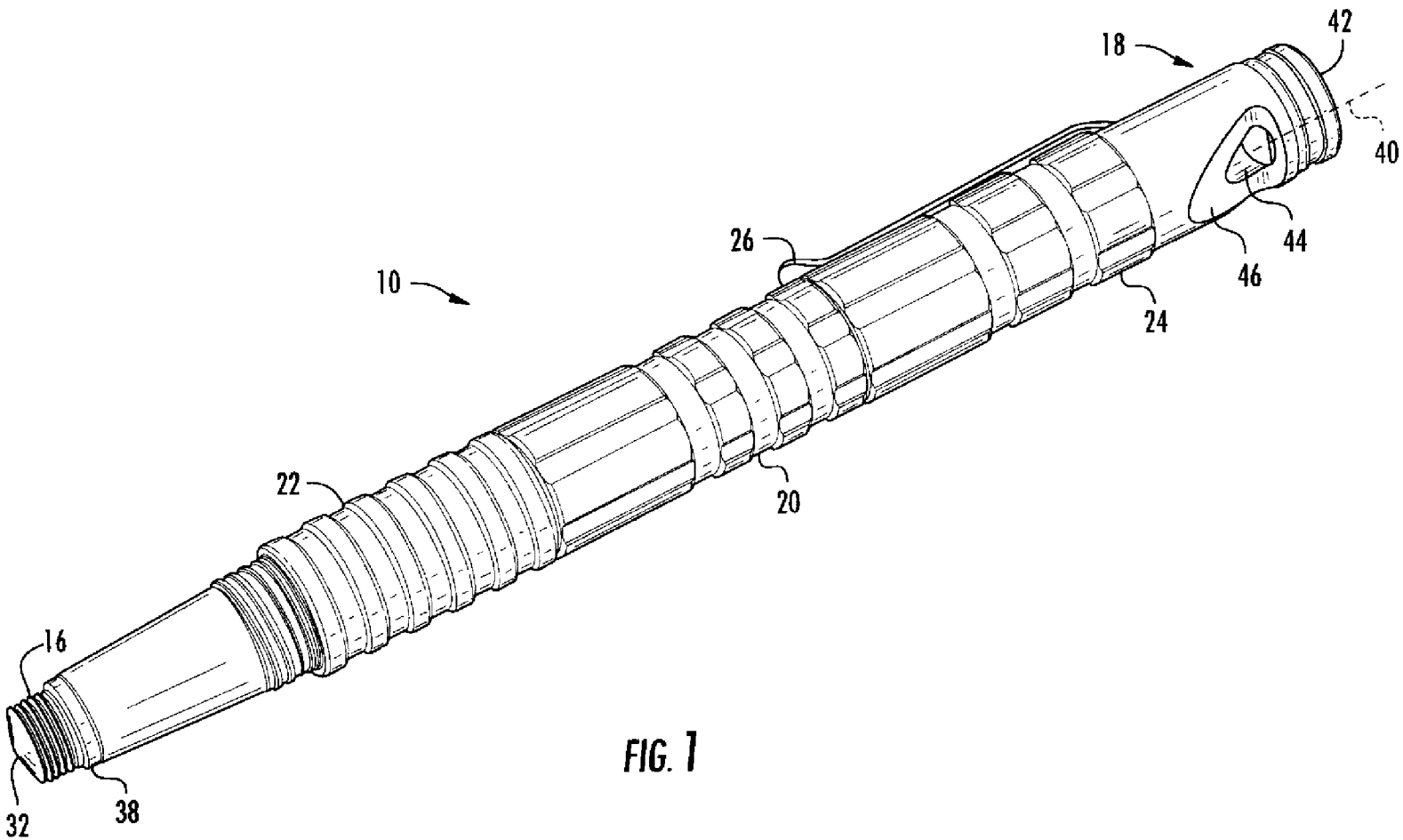
Figure 2:
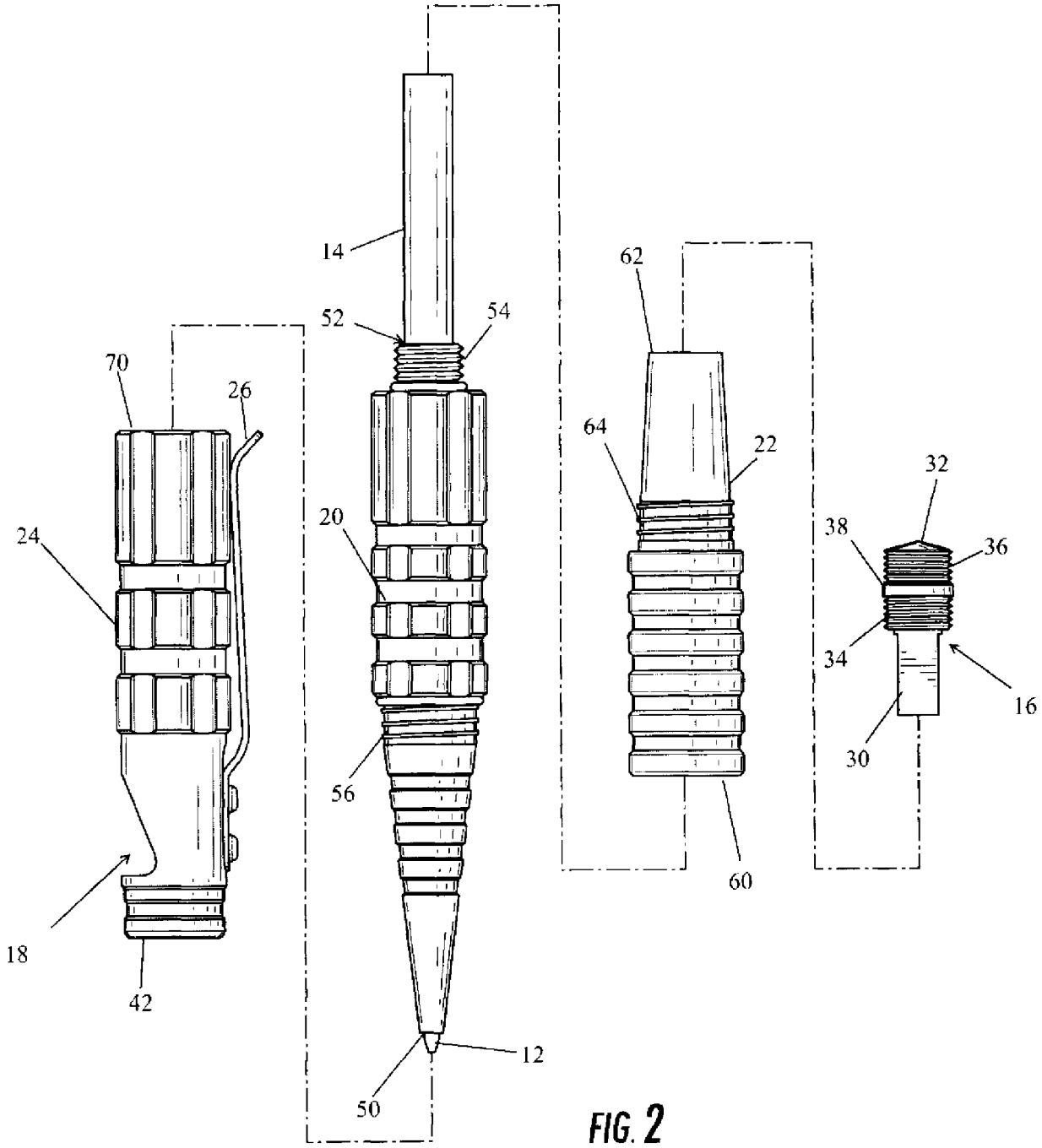
Figure 3:
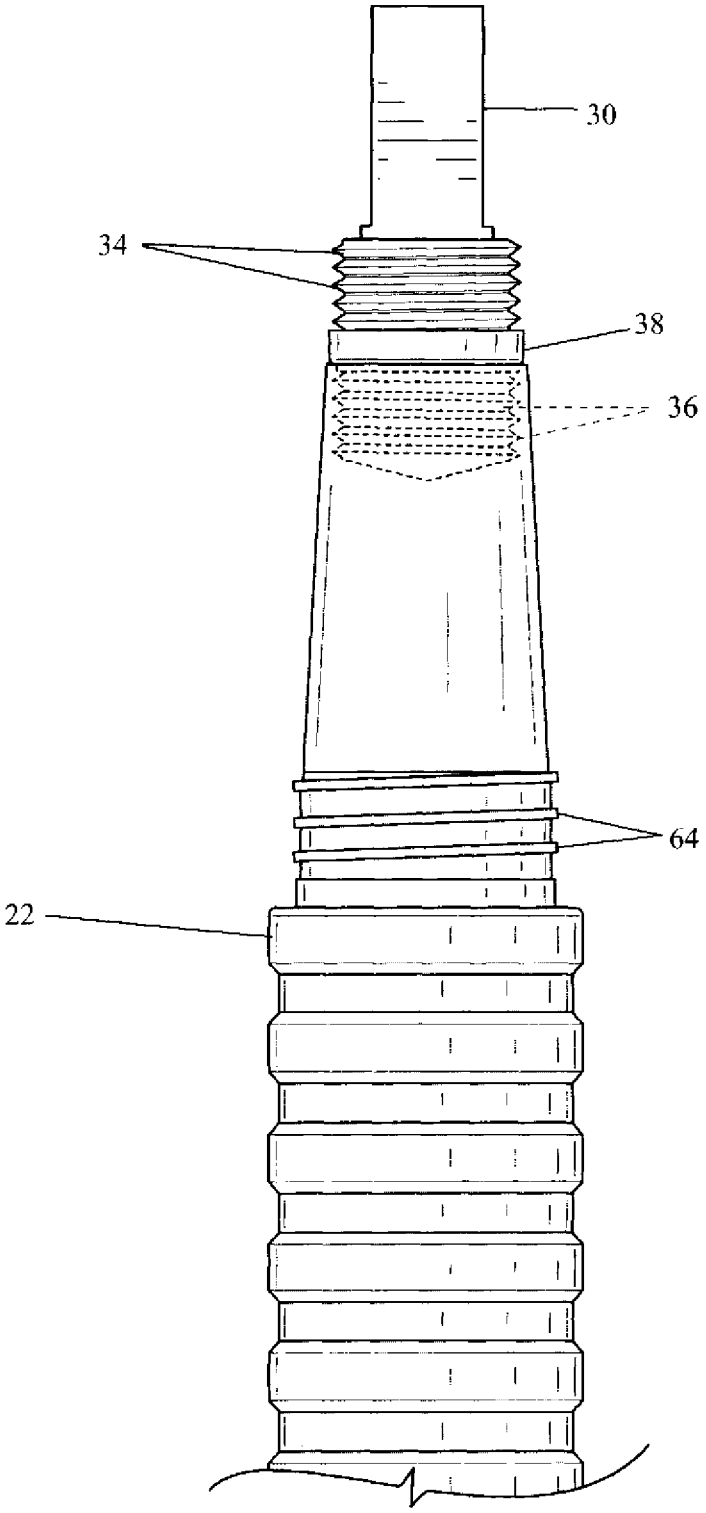
Figure 4:
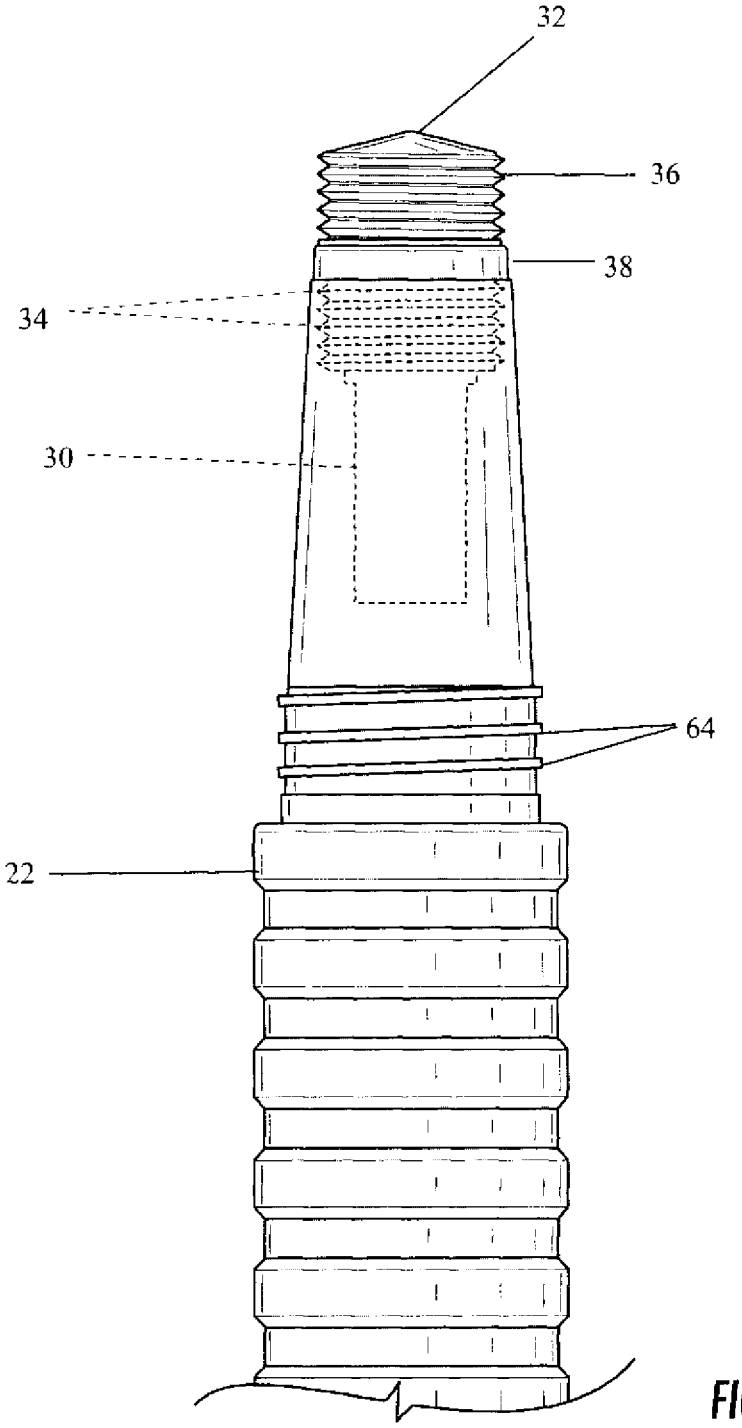
Figure 5:
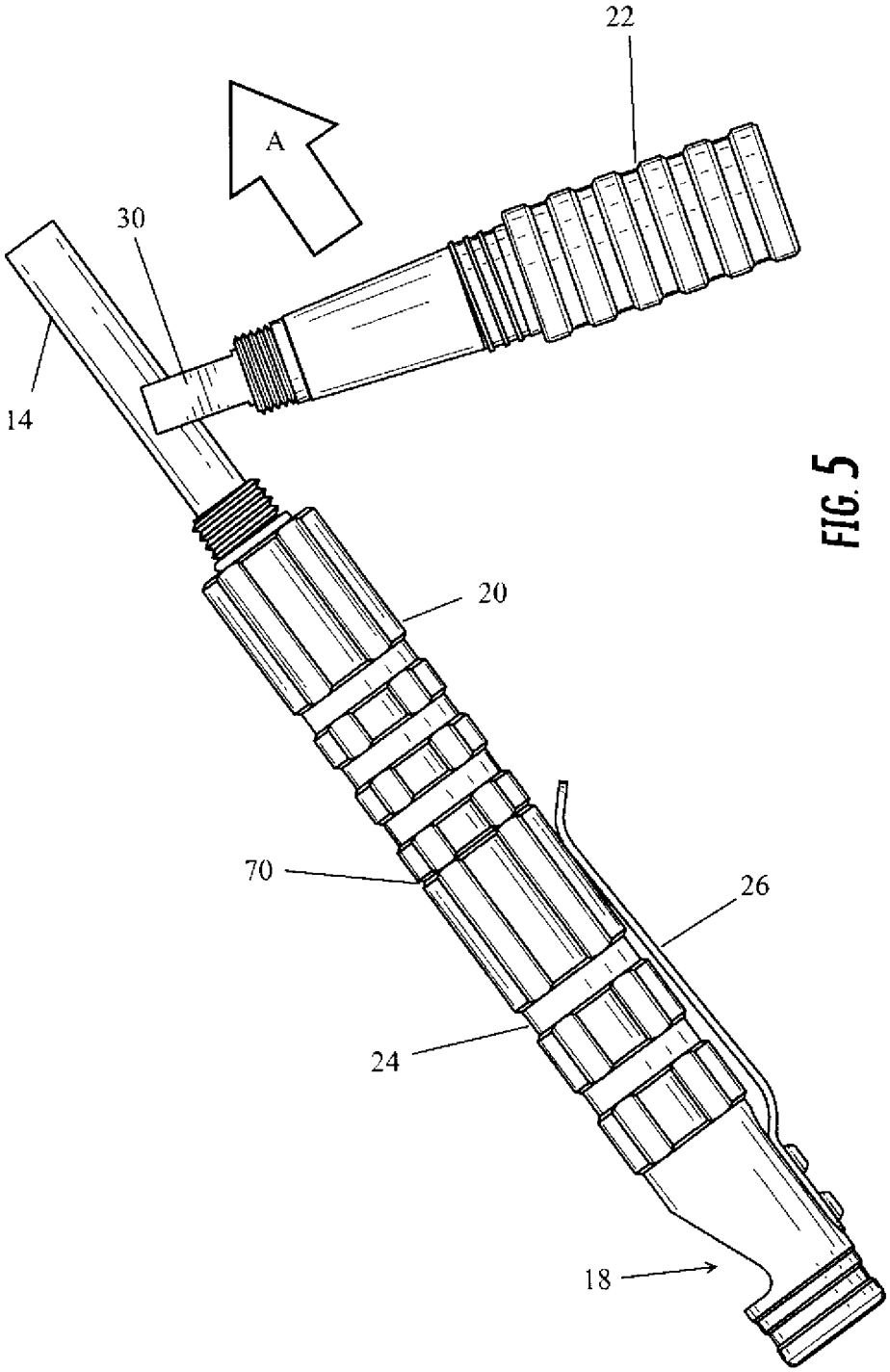

When fully assembled, the pen 10 appears as a writing pen and no visual indication is given that it is has fire starting components. In use, the pen 10 functions as an ordinary writing pen. In a situation where a fire is desired, the pen 10 enables the creation of a spark for lighting flammable materials. With reference to FIG. 5, the body portion 22 is shown removed from the main body portion 20 and having the striker 16 oriented to expose the elongate portion 30. As indicated by the arrow A, the body portion 22 may be manipulated by the user to vigorously strike the elongate plate 30 against the ferro rod 14 to result in generation of sparks for starting a fire.

Accordingly, it will be appreciated that the structure of the pen 10 provides an ink pen with fire starter for functioning as a writing instrument and both a whistle and a survival fire starting device.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A writing pen, comprising:

a first pen portion containing an ink cartridge;

a ferro rod extending from the first pen portion;

a removable second pen portion removably positionable over the first pen portion, the second pen portion including a whistle integrally formed therewith and having a windway to enable air to flow from a mouthpiece defined on the second pen portion, the whistle being operable when the second pen portion is positioned over the first pen portion and also when the second pen portion is removed from the first pen portion;

a removable third pen portion removably positionable over the first pen portion and overlying the ferro rod to substantially conceal the ferro rod; and a removable striker having a first end configured for contacting the ferro rod to produce a spark and a second opposite end, the striker being reversibly installable onto the third portion so that either the first end of the striker or the second end of the striker extends outwardly from the third pen portion;

wherein, the striker may be installed onto the third pen portion and the third pen portion removed from the first pen portion to expose the ferro rod, and the user may install the striker on the third pen portion to position the first end of the striker to extend outwardly from the third pen portion and manipulate the striker to strike against the ferro rod generate sparks for making a fire.

2. The pen of claim 1, wherein the first end of the striker comprises an elongate plate.

3. The pen of claim 2, wherein the second end of the striker comprises a pointed head configured for breaking glass.

* * * * *

UNITED STATES PATENT AND TRADEMARK OFFICE

CERTIFICATE OF CORRECTION

PATENT NO. : 8,967,899 B1
APPLICATION NO. : 13/650911
DATED : March 3, 2015
INVENTOR(S) : Jiun-Yu Chu and Morgan Taylor It is certified that error appears in the above-identified patent and that said Letters Patent is hereby corrected as shown below:

Please delete the Title page and insert the Title Page showing the illustrative figure shown on the attached Title page.

Please replace FIGS. 1-5 with FIGS. 1-5 as shown on the attached pages.

Signed and Sealed this
Twenty-ninth Day of March, 2016

Michelle K. Lee

Michelle K. Lee
*Director of the United States Patent and Trademark Office*

(12) United States Patent
Chu et al.

(10) Patent No.: US 8,967,899 B1
(45) Date of Patent: Mar. 3, 2015

(54) INK PEN WITH FIRE STARTER AND WHISTLE

(71) Applicant: Taylor Brands, LLC, Kingsport, TN (US)

(72) Inventors: Jim-Yu Chu, Taipei Hsien (TW); Morgan Taylor, Kingsport, TN (US)

(73) Assignee: Taylor Brands, LLC, Kingsport, TN (US)

( * ) Notice: Subject to any disclaimer, the term of this patent is extended or adjusted under 35 U.S.C. 154(b) by 288 days.

(21) Appl. No.: 13/650,911

(22) Filed: Oct. 12, 2012

Related U.S. Application Data

(63) Continuation-in-part of application No. 12/833,376, filed on Jul. 9, 2010, now Pat. No. 8,348,539.

(51) Int. Cl.
*B43K 29/00* (2006.01)
*B43K 29/16* (2006.01)
*B43K 29/20* (2006.01)

(52) U.S. Cl.
CPC ..... *B43K 29/16* (2013.01); *B43K 29/005* (2013.01); *B43K 29/20* (2013.01)
USPC ..... 401/195; 431/273; 44/507

(58) Field of Classification Search
CPC ..... B43K 29/16; B43K 29/20; B43K 29/005
USPC ..... 401/195; 44/506–510; 431/273
See application file for complete search history.

(56) References Cited

U.S. PATENT DOCUMENTS

| | | | | |
|---|---|---|---|---|
| 3,448,541 | A * | 6/1969 | Barlow | 446/81 |
| 4,698,068 | A | 10/1987 | Jensen | |
| 4,770,669 | A | 9/1988 | Allen et al. | |
| 5,214,853 | A | 6/1993 | Bray et al. | |
| 5,279,628 | A | 1/1994 | Hutchens et al. | |
| 5,454,657 | A | 10/1995 | Kim | |
| 5,580,239 | A | 12/1996 | Jang | |
| 5,645,415 | A | 7/1997 | Hamel | |
| 5,919,037 | A | 7/1999 | Brillhart, III et al. | |
| 6,782,576 | B1 | 8/2004 | Valencic et al. | |
| 7,176,367 | B2 * | 2/2007 | Yeh | 84/380 R |
| 7,866,840 | B2 | 1/2011 | Padden | |
| 8,186,995 | B2 | 5/2012 | Petrello, Jr | |
| 8,348,539 | B2 | 1/2013 | Chu et al. | |
| 2010/0136495 | A1 | 6/2010 | Weston et al. | |

* cited by examiner

*Primary Examiner* David Walczak
*Assistant Examiner* Jennifer C Chiang
(74) *Attorney, Agent, or Firm* Luedeka Neely Group, PC

(57) ABSTRACT

A writing pen, including a first pen portion containing an ink cartridge, a ferro rod extending from the first pen portion, and a removable second pen portion removably positionable over the first pen portion. The second pen portion includes a whistle integrally formed therewith. A third pen portion is removably positionable over the first pen portion and overlys the ferro rod to substantially conceal the ferro rod. A removable striker having a first end configured for contacting the ferro rod is installable onto the third pen portion so that either the first end of the striker or the second end of the striker extends outwardly from the third pen portion.

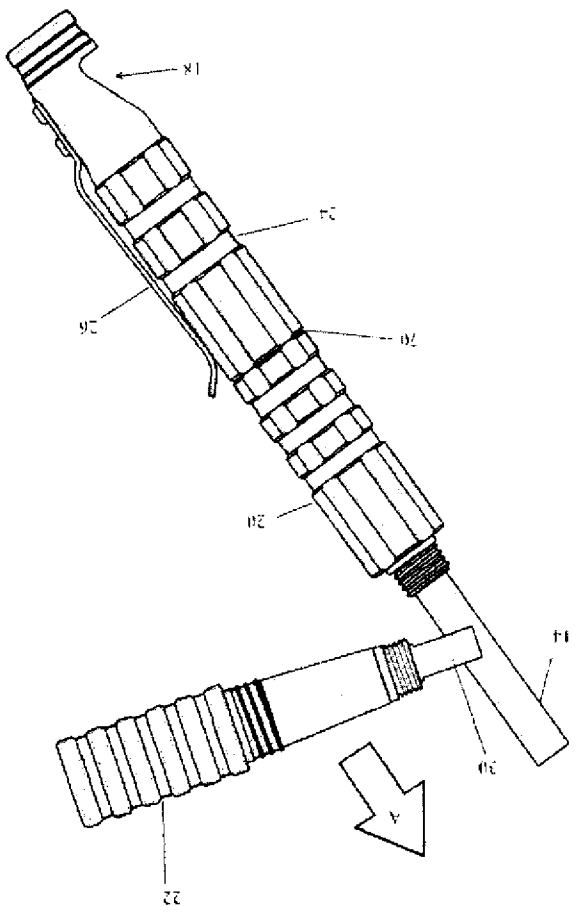

3 Claims, 5 Drawing Sheets